US012163412B2

(12) United States Patent
Critsinelis et al.

(10) Patent No.: US 12,163,412 B2
(45) Date of Patent: Dec. 10, 2024

(54) DRILLING INTELLIGENCE GUIDANCE SYSTEM FOR GUIDING A DRILL

(71) Applicant: Inventus Holdings, LLC, Juno Beach, FL (US)

(72) Inventors: Dimitri C. Critsinelis, Houston, TX (US); Dustin S. Claiborne, Alvin, TX (US); Kiran Singh, Jupiter, FL (US); Hamzah M. Al-Najada, Boca Raton, FL (US); Gunjan Neopaney, Katy, TX (US); Sri Vaishnavi Vemulapalli, Palm Beach Gardens, FL (US); Hooman Yousefizadeh, Port St. Lucie, FL (US); Andrew B. Stokes, Jr., Houston, TX (US); Vincent P. LeMoine, The Woodlands, TX (US)

(73) Assignee: INVENTUS HOLDINGS, LLC, Juno Beach, FL (US)

( * ) Notice: Subject to any disclaimer, the term of this patent is extended or adjusted under 35 U.S.C. 154(b) by 0 days.

(21) Appl. No.: 17/987,134

(22) Filed: Nov. 15, 2022

(65) Prior Publication Data

US 2024/0159136 A1 May 16, 2024

(51) Int. Cl.
*E21B 44/00* (2006.01)

(52) U.S. Cl.
CPC ..... *E21B 44/00* (2013.01); *E21B 2200/22* (2020.05)

(58) Field of Classification Search
CPC ..... E21B 44/00; E21B 44/005; E21B 44/02; E21B 2200/22; E21B 41/00; E21B 49/003; E21B 2200/20; E21B 12/02; E21B 47/26; E21B 41/0092; E21B 47/00; E21B 47/013; E21B 7/04; E21B 19/166; E21B 45/00; E21B 47/007; E21B 47/01; E21B 7/00
See application file for complete search history.

(56) References Cited

U.S. PATENT DOCUMENTS 10,657,441 B2 5/2020 Dursun
11,041,371 B2 * 6/2021 Camacho Cardenas ..... E21B 41/00

(Continued)

OTHER PUBLICATIONS

Lawal, et al., "Real-Time Prediction of Mud Motor Failure Using Surface Sensor DataFeatures and Trends", IADC Society of Petroleum Engineers, 2021, pp. 1-17.

(Continued)

*Primary Examiner* — Kipp C Wallace
(74) *Attorney, Agent, or Firm* — Tarolli, Sundheim, Covell & Tummino LLP

(57) ABSTRACT

A system for guiding a drill assembly boring the Earth can include a drill controller engine that receives parameters characterizing sensor data from a plurality of sensors of the drill assembly, and a condition of the drill assembly. The parameters and condition can be aggregated into a historical record. A subset of the parameters can be selected based on a relationship between the subset of parameters and the condition of the drill assembly, the relationship being determined by a drill assembly machine learning model. A Damage Index (DI) can be calculated from the subset of parameters. The DI can be matched with a plurality of DIs computed for the historical record to determine a risk of failure of the drill assembly. The drilling operations of the drill assembly can be adjusted by the drill controller engine in response to the risk of failure.

21 Claims, 6 Drawing Sheets

(56) References Cited

U.S. PATENT DOCUMENTS

| | | | | |
|---|---|---|---|---|
| 11,066,917 | B2 | 7/2021 | Jain | |
| 2014/0121973 | A1* | 5/2014 | Buchanan | G01M 5/0033 702/6 |
| 2016/0341636 | A1* | 11/2016 | Rajaram | G06Q 50/06 |
| 2017/0292362 | A1* | 10/2017 | Aniket | E21B 47/007 |
| 2018/0179888 | A1* | 6/2018 | Switzer | E21B 47/125 |
| 2019/0292908 | A1 | 9/2019 | Karimi Vajargah | |
| 2019/0345809 | A1* | 11/2019 | Jain | E21B 47/26 |
| 2020/0141225 | A1* | 5/2020 | Aniket | E21B 41/0092 |
| 2020/0193223 | A1* | 6/2020 | Hazard | G06V 10/764 |
| 2020/0291764 | A1* | 9/2020 | Chahine | E21B 44/00 |
| 2021/0032936 | A1* | 2/2021 | Zhan | E21B 44/00 |
| 2021/0062619 | A1* | 3/2021 | Camacho Cardenas | G05B 23/024 |
| 2021/0293136 | A1* | 9/2021 | Newhouse | E21B 44/00 |
| 2021/0363871 | A1* | 11/2021 | Samuel | E21B 12/02 |
| 2022/0122001 | A1* | 4/2022 | Choe | G06N 20/20 |
| 2022/0285028 | A1* | 9/2022 | Ediebah | G16H 50/20 |
| 2023/0104028 | A1* | 4/2023 | Wang | G05B 23/0283 702/183 |

OTHER PUBLICATIONS

International Search Report for corresponding PCT/US2023/035314, mailed Nov. 30, 2023.

* cited by examiner

DRILLING INTELLIGENCE GUIDANCE SYSTEM FOR GUIDING A DRILL

TECHNICAL FIELD

The present disclosure relates to intelligent drilling and more particularly to systems and methods for implementing a damage index (DI) for intelligently guiding a drilling a tool.

BACKGROUND

A drilling rig is a system that drills wells, such as oil or water wells, in the Earth's subsurface. Drilling rigs can be large structures that house equipment used to drill water wells, oil wells, or natural gas extraction wells, or drilling rigs can be small enough to be moved manually by one person and such are called augers. Drilling rigs can sample subsurface mineral deposits, test rock, soil and groundwater physical properties, and also can be used to install subsurface fabrications, such as underground utilities, instrumentation, tunnels or wells. Drilling rigs can be mobile equipment mounted on trucks, tracks or trailers, or more permanent land or marine-based structures (such as oil platforms, commonly called 'offshore oil rigs' even if they don't contain a drilling rig).

Larger rigs are capable of drilling through thousands of meters of the Earth's crust, using large "mud pumps" to circulate drilling mud (slurry) through the drill bit and up the casing annulus, for cooling and removing the "cuttings" while a well is drilled. Hoists in the rig can lift hundreds of tons of pipe. Other equipment can force acid or sand into reservoirs to facilitate extraction of the oil or natural gas, and in remote locations there can be permanent living accommodation and catering for crews (which may be more than a hundred).

SUMMARY

One example relates to a non-transitory computer readable medium storing a computer readable program that causes the program to receive, by receive, by a drill controller engine, a set of parameters characterizing sensor data from a plurality of sensors corresponding to drilling operations of a drilling tool for boring the Earth, and a condition of the drilling. Additionally, the drill controller engine can aggregate the set of parameters and the condition of the drill assembly into a historical record over time. Further, a drill assembly machine learning model can select a subset of parameters of the set of parameters related to the condition of the drill assembly, wherein a relationship between the subset of parameters to the condition are determined and weighted by a drill assembly machine learning model. Furthermore, a damage index (DI) engine can compute a DI for the subset of the set of parameters. The DI engine can also match the computed DI to a plurality of DIs for the historical record over time to determine a risk of failure of the drill assembly based on the DI. Thus, the drill controller engine can adjust the drilling operation of the drill assembly to change a given parameter in response to the determined risk of failure.

Another example relates to a system for intelligently guiding a drill assembly. The system can include a drill assembly configured to perform a drilling operation for boring the Earth. The system can further include a plurality of sensors coupled to the drill assembly, the plurality of sensors being configured to provide parameters characterizing sensor data from the drill assembly and the drilling operation to a computing platform. Further, the system can include a drill controller engine that receives the set of parameters from the plurality of sensors and a condition of the drill assembly. The drill controller engine can also aggregate the set of parameters and conditions of the drill assembly into a historical record over time. The system can further include a drill assembly machine learning model that selects a subset of parameters of the set of parameters related to the condition of the drill assembly, wherein a relationship between the subset of parameters to the condition are determined and weighted by a drill assembly machine learning model. Additionally, the system can include a damage index (DI) engine that computes a damage index (DI), wherein the DI is a value obtained from performing a function on the subset of parameters. The DI engine can also match the computed DI to a plurality of DIs for the historical record over time to determine a risk of failure of the drill assembly based on the DI, the risk of failure being low, medium, or high. Moreover, the drill controller engine can further adjust the drilling operation of the drill assembly to change a given parameter in response to the determined risk of failure, wherein a low risk of failure corresponds to a DI below a sub-optimal threshold, a medium risk of failure corresponds to a DI above the sub-optimal threshold, and a high risk of failure corresponds to a DI above a failure threshold.

Still another example relates to a method for guiding drill assembly operations. The method can include receiving, by a drill controller engine, a set of parameters from a plurality of sensors that characterize a drill assembly and drilling operation, and a condition of the drill assembly. The method also includes aggregating, by the drill controller engine, the set of parameters and condition into a historical record over time, wherein the historical record stores parameters and conditions from at least one other drill assembly and corresponding drilling operations. The method further includes selecting, by a drill assembly machine learning model, a subset of parameters of the set of parameters related to the condition of the drill assembly, wherein a relationship between the subset of parameters and the condition are determined and weighted by the drill assembly machine learning model. Furthermore, the method includes computing, by a damage index (DI) engine, a DI for the subset of the set of parameters. Additionally, the method includes matching, by the DI engine, the computed DI to a plurality of DIs for the historical record over time to determine a risk of failure of the drill assembly based on the DI, the risk of failure being low, medium, or high. Further still, the method includes adjusting, by the drill controller engine, the drilling operation of the drill assembly to change a given parameter in response to the determined risk of failure, wherein a low risk of failure corresponds to a DI below a sub-optimal threshold, a medium risk of failure corresponds to a DI above the sub-optimal threshold, and a high risk of failure corresponds to a DI above a failure threshold.

DETAILED DESCRIPTION

Figure 1:
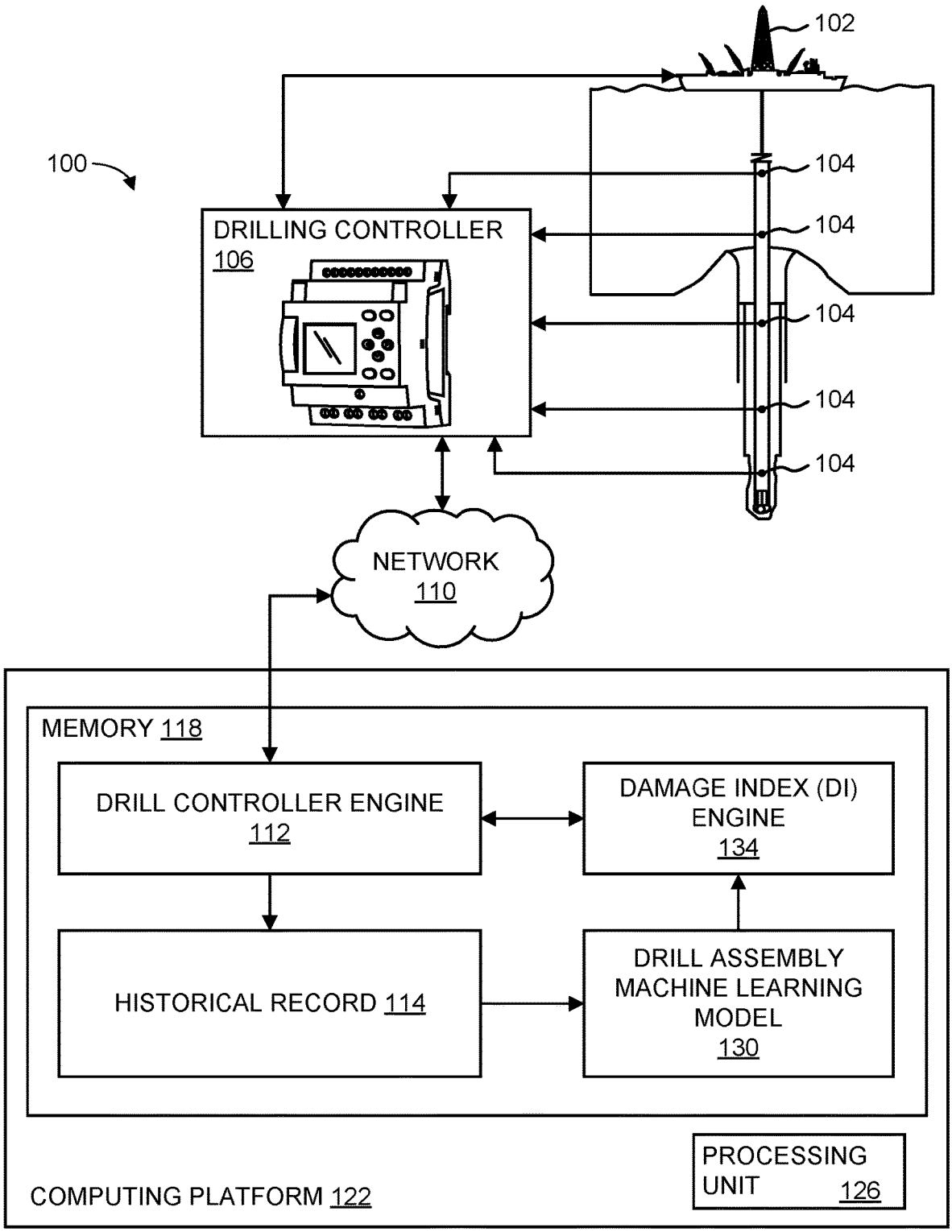
FIG. 1 illustrates an example of an intelligent drilling guidance system.

The present disclosure relates to systems and methods for intelligently guiding a drilling system. Particularly, a drill configured to drill the Earth (e.g., Earth's crust) can include a drill bit, motors, pumps, and thousands of sensors. Drilling operations performed by the drill assembly cause stress to the drill bit, motors, pumps, and other components of the drill assembly. Stress, for example, can be characterized by deterioration, wear, and failure modes of the components of the drill assembly. Stress caused by drilling operations on the drilling equipment can be the result of factors including mechanical (e.g., operating torque, tension, compression, friction, motor stalls), environmental (e.g., temperature, pressure, fluid properties), methodical (e.g., data silos, operating parameters), operational (e.g., torque, operating pressure), and measurement (e.g., operating time, calibration of sensors) parameters. When the drill assembly or a drill component (e.g., a motor) fails due to stress, drilling operations are ceased for an average of 48 hours to repair or replace the failed drill assembly or drill component. Accordingly, the drilling intelligence guidance system identifies parameters that contribute to stress that results in failures of the drill assembly, such that the drilling intelligence guidance system can adjust operational parameters of the drill during drilling operations.

The parameters that contribute to stress on the drilling operations are characterized by data collected by hundreds, or even thousands of sensors located on surface or downhole on the drill assembly at or on the drill. The parameters collected from the sensors, as well as the condition of the drill (e.g., component failure), are stored in a historical record over time. The historical record also stores data related to other drilling operations of the drill assembly. That is, the historical record can store data related to drilling operations of the drill assembly in another drilling basin or region, as well as other drilling operations of the drill assembly in the same drilling basin or region. Further, the historical record stores parameters and conditions of a plurality of other drilling assemblies collected during previous drilling operations at the same, or another, drilling basin or region. Additionally, the historical record can store data related to the drill assembly and drilling operations, such as engineering data, vendor or equipment supplier information (e.g., operating envelopes, efficiency operating zones, design basis). Subsequently, the historical record of parameters and conditions of the drill assembly are provided to a drill assembly machine learning model that identifies particular parameters that contribute greatest to an identified condition.

A Damage Index (DI) can be calculated by performing a function on the particular parameters. Particularly, the DI is a value normalized between 0.0 and 4.0, or a range of floating-point values based on a minimum and maximum produced by the function of the particular parameters. The DI can be calculated by a DI engine, which can be a software program that performs functions for other programs, such as a drill assembly machine learning model. Alternatively, the DI can be calculated by a drill assembly controller or the drill assembly machine learning model. If the DI is below a first threshold, the DI indicates that the drill assembly is operating in an optimal state. If the DI is above the first threshold, the DI indicates that the drill assembly is operating in a sub-optimal state, such that the condition corresponding to the particular parameters is at risk. If the DI is above a second threshold, the DI indicates that the drill assembly is in a failure state, such that the condition corresponding to the particular parameters has failed. Alternatively, if the DI is above the second threshold, the DI indicates that the drill assembly is in a failure state, such that the condition corresponding to the parameters is likely to fail. Stated differently, a drill assembly in a failure state has a higher risk of failure than a drill assembly in a sub-optimal state.

Additionally, the DI can be calculated over time to predict future parameters and a corresponding future state of the drill. Therefore, the DI can be used to predict failure of a given condition based on the predicted future state of the drill. Thus, the DI can be used to adjust drilling operations via operational parameters to prevent failure of the given condition. For example, the given condition can be related to the drill bit, such that the DI indicates that the drill bit is operating at a sub-optimal state. Therefore, operational parameters, such as flow rate, can be adjusted (e.g., decreased) to extend the life of the drill bit and prevent failure of the drill bit. Alternatively, operational parameters, such as flow rate, can be adjusted (e.g., increased), if the DI indicates that the drill bit is operating at an optimal state and that future states of the drill bit will remain at an optimal state if operational parameters (e.g., flow rate) are adjusted accordingly. The drilling intelligence guidance system further calibrated is calibrated to have operational parameter "guardrails" to ensure, no matter what the condition is, the intelligent control will not violate safety margins operating the drilling intelligence guidance system (fail safe against machine "dumb/blind" decision). That is, the operational parameter guardrails can define a safe range of corresponding values of the respective operational parameter. Accordingly, the DI can be employed to assess and extend the life of the drill assembly and drill components, as well as increase operational performance of the drill assembly by increasing the output of the drilling operations without increasing risk of failure to the drill. The DI can also provide input for maintenance opportunities (predictive, preventive and corrective) to increase system and component availability, reduce downtime, increase efficiency and capture synergies on logistics.

FIG. 1 illustrates a drilling intelligence guidance system configured to control a drill assembly (surface and downhole equipment) 102. The drill assembly 102 can be implemented as a drilling rig configured to bore into the Earth. Moreover, the drill assembly 102 can be configured to drill deep and long into the Earth (e.g., exceeding about 6 kilometers or about 4 miles) in a harsh drilling environment with temperatures over 178 degrees Celsius (e.g., about 350 degrees Fahrenheit) and reservoir pressures of about 69,000 Kilopascals (e.g., about 10,000 pound-force per square inch). Unless otherwise stated, in this description, 'about' preceding a value means +/−10 percent of the stated value.

The drill assembly 102 can include components such as a mud pump, a drill bit, pipe, agitators, and a motor. Additionally, the drill assembly 102 can include a measurement system that further includes a plurality of sensors 104 located across the drill assembly 102. The plurality of sensors 104 can include hundreds or even thousands of sensors that collect sensor data characterizing drilling operations of the drill assembly 102. The sensors 104 can provide the sensor data to a drilling controller 106. The drilling controller 106 can be implemented as an industrial computer, such as a programable logic controller (PLC). Accordingly, the sensors 104 can provide the drilling controller 106 sensor data via wired connection or short a short range wireless connection (e.g., LAN, Bluetooth, acoustic pulse, etc.). Additionally, the drilling controller 106 can communicate over a network 110. The network 110 can be a point-to-point network, such as a cellular network or a WiFi network. In examples where the network 110 is a cellular network, the cellular network can be implemented with a 3G network, a 4G Long-Term Evolution (LTE) network, a 5G network, etc. The network can also be connected via fiber physical connection such as fiber optic. Network data characterizing the network 110 can be stored on data lakes and data warehouse in the cloud. The drilling controller 106 can be a programmable logic controller.

The drilling controller 106 can characterize the received sensor data as parameters (e.g., environmental, mechanical, methodical, and measurement and operational) of the drill assembly 102. Additionally, the drilling controller 106 can provide operational parameters to the drill assembly 102 to adjust drilling operations of the drill assembly 102. The drilling controller 106 can provide the parameters that characterize the received sensor data to a drill controller engine 112. The drill controller engine 112 can also store parameters characterizing the received sensor data in a historical record 114. Furthermore, the drill controller engine 112 can store a condition of the drill assembly 102 in the historical record 114, the condition being a received state of the drill assembly 102 for a given time corresponding to the parameters stored in the historical record 114. Both the drill controller engine 112 and the historical record 114 can be stored in a memory 118 of a computing platform 122 that also includes a processing unit 126. The historical record 114 can also store parameters and conditions from previous drilling operations of the drill assembly 102 and other drills 102. Additionally or alternatively, the historical record 114 can be a plurality of historical records that includes parameters and conditions of a plurality of drills 102 over time (e.g., other instances of the drill assembly 102 with similar or the same operational performance characteristics, field operating data, equipment vendor data, engineering data).

The memory 118 of the computing platform 122 can store machine readable instructions. The memory 118 could be implemented, for example, as non-transitory computer readable media, such as volatile memory (e.g., random access memory), nonvolatile memory (e.g., a hard disk drive, a solid state drive, flash memory, etc.) or a combination thereof. The processing unit 126 of the computing platform 122 can access the memory 104 and execute the machine-readable instructions. The processing unit 126 can include, for example, one or more processor cores. The computing platform 122 can include a network interface configured to communicate with a network 110. The network interface could be implemented, for example, as a network interface card.

Further, the computing platform 112 could be implemented in a computing cloud. The computing cloud can include real time (e.g., within 10 seconds) bi-directional access and cyber security handshaking. In such a situation, features of the computing platform 112, such as the processing unit 126, the network interface, and the memory 118 could be representative of a single instance of hardware or multiple instances of hardware with applications executing across the multiple of instances (i.e., distributed) of hardware (e.g., computers, routers, memory, processors, or a combination thereof). Alternatively, the computing platform 122 could be implemented on a single dedicated server.

A drill assembly machine learning model 130 can be provided the historical record 114 of parameters and conditions over a period of time. That is, the drill assembly machine learning model 130 can receive the historical record 114 as an input and output a relationship between the parameters and conditions of the historical record 114. Thus, the relationship between the parameters and conditions of the historical record 114 are used to generate a Damage Index (DI), which is a computation employed to predict an operational state of the drill assembly 102. Particularly, the DI can be calculated by a DI engine 134. Alternatively, computation of the DI can be performed by the drill controller engine 112. Accordingly, the drill controller engine 112 can provide the DI engine 134 with parameters characterizing sensor data received during a given drilling operation. In response, the DI 134 can provide the drill controller engine 112 with a risk of failure and/or a prediction of a future risk of failure of the drill assembly 102. Therefore, the drill controller engine 112 can adjust the drilling operations of the drill assembly 102 based on the risk of failure of the drill assembly 102 by providing the drill controller 106 with operational parameters. In some examples, the drill controller engine 112, the DI Engine 134, and the drill assembly machine learning model 130 can be integrated.

Figure 2:
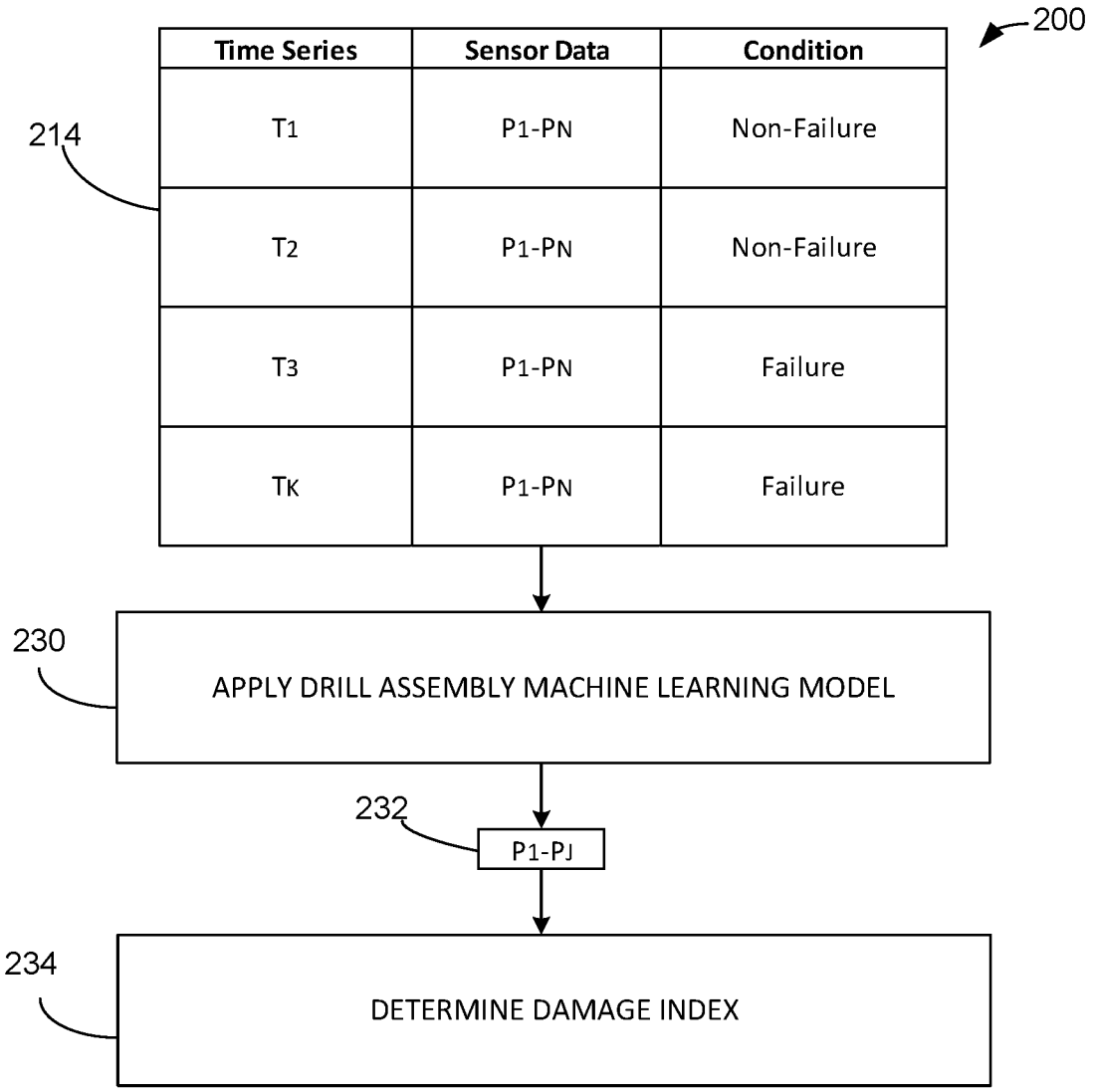
FIG. 2 illustrates a flowchart of a method for applying a drilling machine learning model to a historical record.

FIG. 2 illustrates a flowchart of an example method 200 that can be executed by the drill controller engine 112 of FIG. 1 for providing a historical record 214 (e.g., historical record 114 of FIG. 1) to a drill assembly machine learning model 230 (e.g., drill assembly machine learning model 130 of FIG. 1). FIG. 2 also illustrates an example of a historical record 214 of parameters and conditions of a drill. As shown, the historical record 214 can store parameters and conditions for a given instance of time in a time series T1-TK, where K is a non-zero integer. For each instance of time, the historical record 214 stores parameters P1-PN characterizing sensor data, where N is an integer greater than or equal to two. Again, parameters P1-PN can be a set of parameters characterizing data collected by hundreds or thousands of sensors located at or on a drill. Additionally, the example historical record 214 stores a condition of the drill assembly for each instance of time, such as a failure or non-failure condition. Alternatively, the condition for each instance of time can be a specific condition of the drill assembly or a component of the drill assembly, such as a motor stall, pump failure, or a broken drill bit. The conditions of the example historical record 214 can be provided by a user, or by a drilling controller (e.g., the drilling controller 106 of FIG. 1).

Furthermore, the historical record 214 can be imbalanced. That is, drilling operations are performed continuously in a non-failure state, whereas drilling operations are terminated when a failure state is detected. Therefore, a majority class of parameters over T1-TK have a non-failure condition, whereas a minority class of parameters over T1-TK have a failure condition. An imbalanced historical record 214 can result in bias (e.g., overfitting) towards the majority class an imbalanced historical record 214 is provided to the drill assembly machine learning model 230. Accordingly, an oversampling technique can be applied to the historical record 214 to balance the historical record prior to applying machine learning. Oversampling can be performed by Synthetic Minority Oversampling Technique (SMOTE), such that additional synthetic examples are generated for the minority class. Thus, SMOTE is used to add synthetic examples of failure conditions (e.g., the minority class) that are correlated to original examples to balance the historical record 214.

At 230, the historical record 214 is provided to a drill assembly machine learning model. The drill assembly machine learning model can be a decision tree, which is employed to determine the relationship between the parameters P1-PN and the conditions of the drill assembly stored in the historical record 214, and to weigh an impact of each parameter on the conditions. Additionally, a random forest model that employs a plurality of decision trees (e.g., 100) can be employed to overcome overfitting.

At 232, the drill assembly machine learning model (e.g., the drilling toll machine learning model 130 of FIG. 1) can output a subset of parameters P1-PJ in response to receiving the historical record 214, where J is an integer greater than or equal to one and less than N. That is, the drill assembly machine learning model determines the subset of parameters P1-PJ of the historical record 214 that are most indicative of the condition of the drill. Furthermore, data stored for a given parameter (e.g., P1) can be analyzed over time (T1-TK) to determine levels of stress and how given parameter contributes to the condition over time. Accordingly, the drill assembly machine learning model can be applied to determine levels of the given parameter that increase stress and therefore result in failure conditions. That is, the drill assembly machine learning model is employed to select a subset of parameters P1-PJ, apply weights to each parameter of the subset of parameters P1-PJ, and apply weight to different levels (e.g., ranges of values) of each parameter of the subset of parameters P1-PJ.

At 234, a Damage Index (DI) is generated by a DI Engine (e.g., the DI Engine 134 of FIG. 1) using the output of the drill assembly machine learning algorithm, or the weighted subset of parameters P1-PJ. The DI is a formula in which low stress levels, medium stress levels, and high stress levels are weighted according to the drill assembly machine learning model and combined with parameters that accumulate over time (e.g., operating time). Thus, the DI is a function of P1-PJ that generates a value representing a risk of failure (e.g., condition) of the drill.

In an example of the method 200, the conditions of the historical record 214 can indicate failure or non-failure of a motor of a drill. As previously stated, a harsh drilling environment that can reach over 178 degrees Celsius (e.g., about 350 degrees Fahrenheit) and over 69,000 Kilopascals can result in motor failure. Particularly, motors can stall or an elastomer (e.g., internal rubber coating of a motor) can fatigue, such that drilling operations of the drill assembly need to be ceased to repair/replace a component of the drill assembly. The historical record 214 can be balanced using SMOTE and provided to the drill assembly machine learning model at 230, which is used to determine and weighs a subset of the parameters 232. In this example, where failure and non-failure conditions of the motor of the drill assembly are provided to the drill assembly machine learning model 230, the drill assembly machine learning model 230 can determine that the subset of parameters 232 of differential pressure, rotary torque, temperature, time of drilling operations, and depth and length contribute the most to motor failure. As discussed, time of drilling and depth are parameters that may accumulate over time. In contrast, pressure for example, can spike and vary at different levels, each level causing different levels of stress to the motor.

Figure 3:
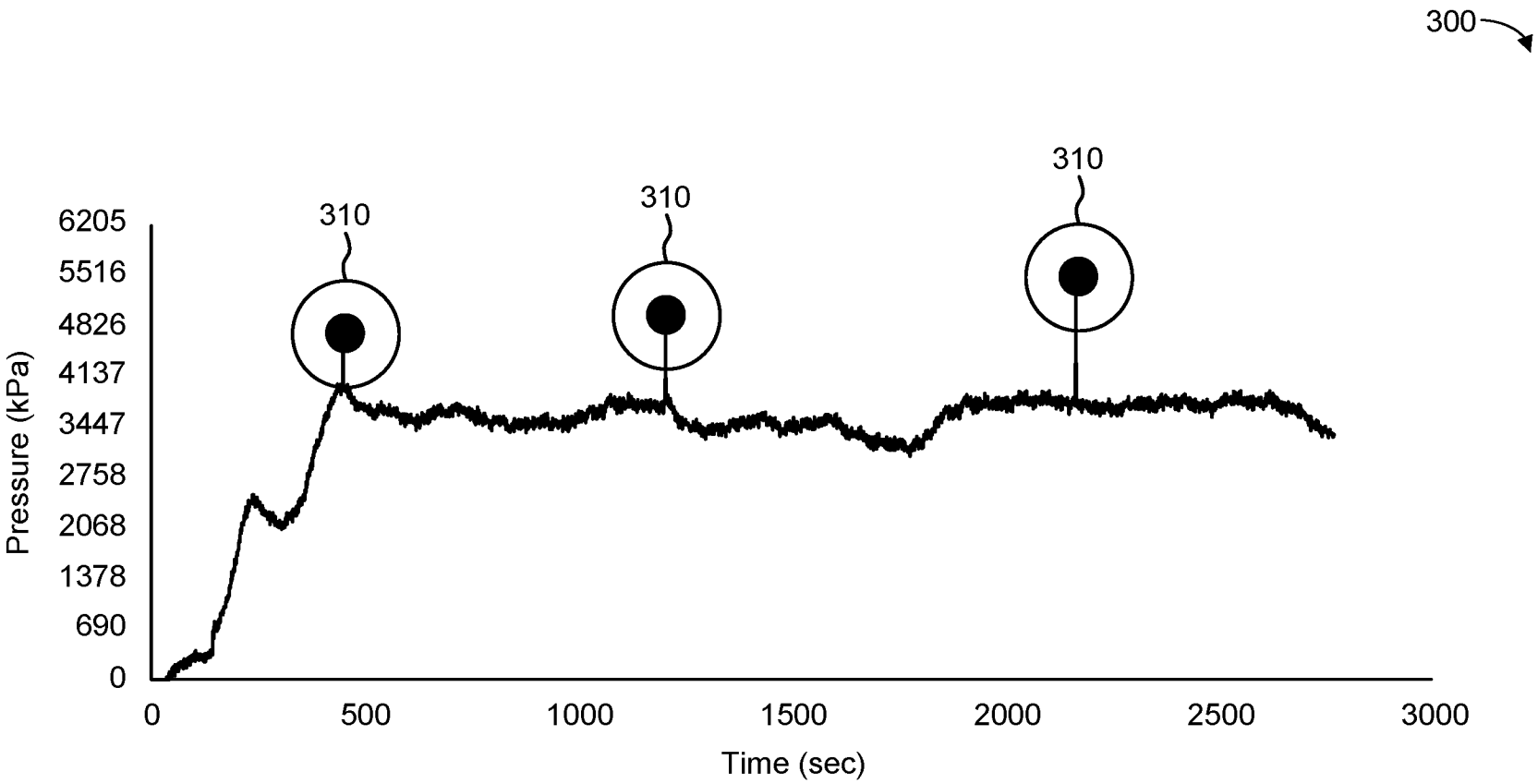
FIG. 3 illustrates an example of a pressure parameter over time.

FIG. 3 illustrates and example chart of a pressure parameter recorded during drilling operations of a drill assembly 300, which can be a parameter of the subset of parameters 232 of FIG. 2. Particularly, FIG. 3 illustrates pressure over time, including spikes in pressure 310. A drill assembly machine learning model, such as the drill assembly machine learning model 130 of FIG. 1, can determine levels of pressure that contribute to a high, medium, or low levels of stress to a motor of a drill assembly (e.g., as indicated by operation 230 of FIG. 2). Accordingly, low levels of stress could be less than about 965 kPa (e.g., about 140 psi), medium levels of stress can be between about 965 kPa and about 1,516 kPa (e.g., about 140 psi and about 220 psi), and high levels of stress can be about 1,516 kPa and above. Thus, the machine learning model can determine both that pressure is a parameter that contributes (compared to P1-PN) to motor condition, and what levels of pressure contribute to the failure of the motor. Stated differently, the proper superset of parameters P1-PN that are not in the subset of parameters P1-PJ are insignificant to determining the condition of the motor. Accordingly, the proper superset of parameters P1-PN includes at least one in parameter P1-PN that is not included in the subset of parameters P1-PJ.

As previously stated, pressure can contribute to stress on the motor of a drill assembly. Additionally or alternatively, other parameters such as temperature can further exacerbate the stress caused by pressure. Accordingly, spikes in pressure 310 can also contribute to stress on the motor of the drill assembly. As shown, there are three spikes in pressure 310 over a period of about 3000 seconds (e.g., 50 minutes). The spikes in pressure 310 can occur at different frequencies over time, and the spikes in pressure 310 can be of different magnitudes. Accordingly, the drill assembly machine learning model can apply weight to the pressure parameter, as well as the frequency and magnitude of spikes of the pressure parameter.

Referring back to the example of FIG. 2, the DI for a motor can be a function of the subset of parameters that are determined to contribute to motor failure. As previously stated, the parameters that can contribute to motor failure are differential pressure, rotary torque, temperature, time in hole (e.g., duration of drilling operations), and depth (e.g., depth of drill assembly). Additional parameters that can contribute to motor failure can include a number of rotary-to-slide transitions, back reaming time, motor stalls, and drilling operational states. Furthermore, a DI for different components of the drill assembly can be a function of different parameters. Particularly, the DI for predicting a motor failure can be defined by Equation 1.

$$DI = \left(\alpha_{lis} * \frac{lis}{lis_{avg}}\right) + \left(\alpha_{mis} * \frac{mis}{mis_{avg}}\right) + \left(\alpha_{his} * \frac{his}{his_{avg}}\right) + \left(\alpha_{rst} * \frac{rst}{rst_{avg}}\right) + \left(\alpha_{brt} * \frac{brt}{brt_{avg}}\right) + \left(\alpha_{tih} * \frac{tih}{tih_{avg}}\right) + \left(\alpha_{tdt} * \frac{tdt}{tdt_{avg}}\right) \quad \text{Equation 1}$$

wherein, lis is a low impact pressure spike;

mis is a medium impact pressure spike;

his is a high impact pressure spike;

rst is a total number of rotary-to-slide transitions;

brt is an accumulated back reaming time during non-drilling operations;

tih is an accumulated time in the hole;

tdt is an accumulated drilling time during drilling operations;

α is a feature importance for a corresponding specified feature; and avg is an average occurrence of a corresponding specified feature which resulted in motor damage.

Figure 4:
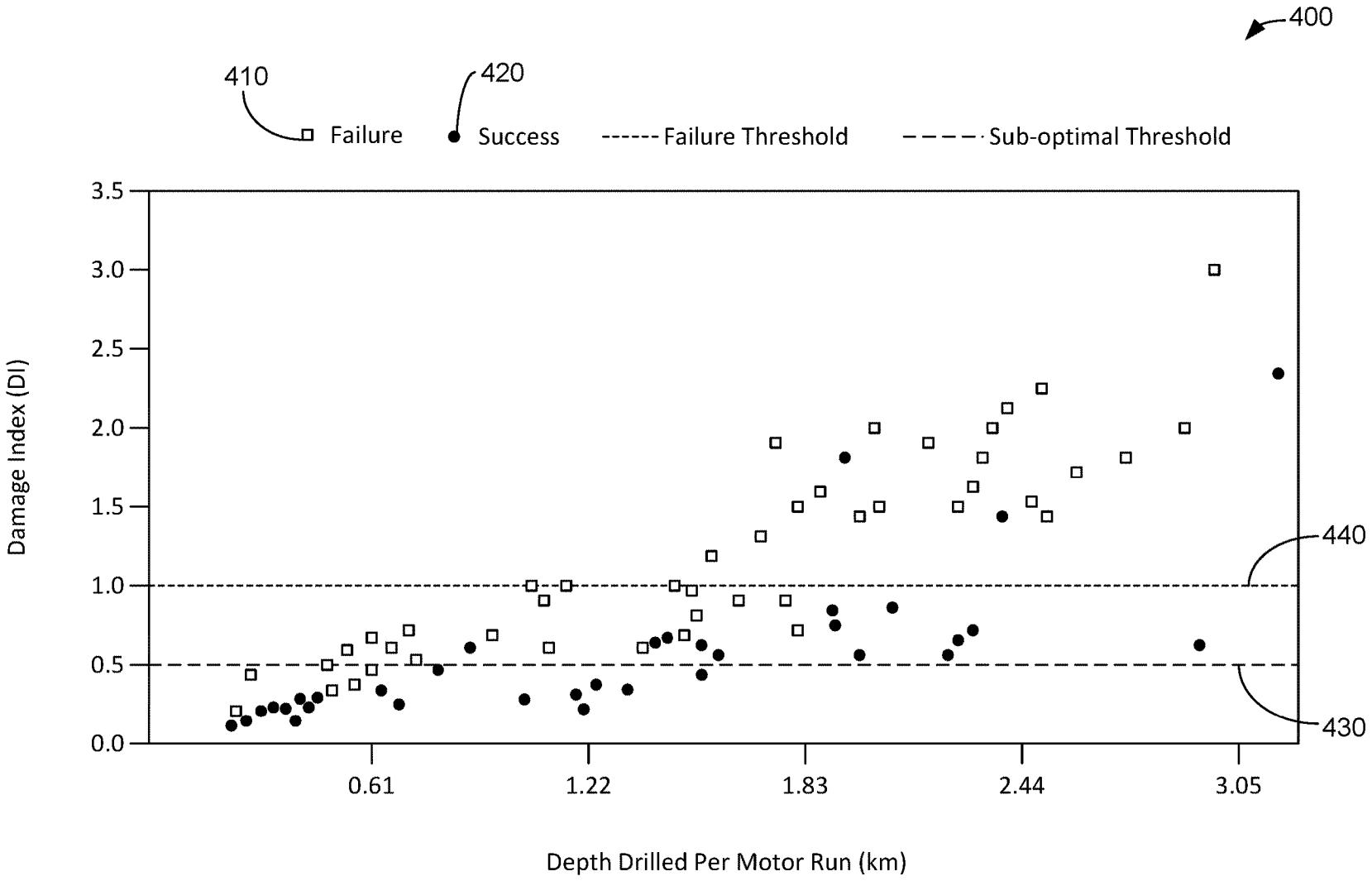
FIG. 4 illustrates an example chart of Damage Index (DI) outputs.

Again, this example of a motor failure references specific drilling operations under a particular set of circumstances, which can include a specific instance of mechanical, environmental, methodical, operational and measurement parameters. However, the drilling intelligence guidance system is applicable under a variety of mechanical, environmental, methodical, measurement and operational parameters, such as varying drilling depths. The DI for predicting motor failure, as above, can be generated using a historical record, such as 214 in FIG. 2. Accordingly, once the DI is generated, the DI can be applied during drilling operations of a drill assembly. That is, the DI can be computed during drilling operations and indicate a risk of failure of a component of the drill assembly as in the example above for motor failures FIG. 4 illustrates an example chart of DI results 400 applied to determine risk of failure for a drill, such that the DI results can be the DI 236 of FIG. 2. The chart of DI results 400 is plotted on the Y-Axis over an X-Axis of Depth Drilled Per Motor Run. As shown, failures 410 are plotted as white squares and successes 420 are plotted as black circles. Additionally, a sub-optimal threshold 430 is shown in the chart of DI results where DI is equal to about 0.5. Furthermore, a failure threshold 440 is shown in the chart of DI results where DI is equal to about 1.0. Thus, DI below the sub-optimal threshold 430 can indicate that a corresponding drill assembly is operating in an optimal state and DI above the failure threshold 440 can indicate that the corresponding drill assembly is operating in a failure state. A DI between the failure threshold 440 and the sub-optimal threshold 430 can indicate that the corresponding drill assembly is operating in a sub-optimal state.

As depicted in the chart of DI results 400, the likelihood of failure increases as the DI increases. In an example, such as the chart of DI results 400, it can be inferred that DI at an optimal state (e.g. 0.0-0.5) has an 80% chance of success, DI at a sub-optimal state (e.g., 0.5-1.0) has a 50% chance of success, and DI at a failure state (e.g., 1.0 and above) has a 14% chance of success. Again, a correlation can be inferred from the DI and failure rates, as inferred from historical records of parameters and failure/non-failure conditions. Accordingly, the DI can be employed during drilling operations to determine a risk of failure based on the state of the DI. Particularly, a risk of failure of a drill assembly can correspond to the chance of success inferred from the DI. For instance, if the DI of a drill assembly is above the failure threshold and a corresponding drill assembly is operating in a failure state (e.g., 1.0 or above), the risk of failure can be high. If the DI of a drill assembly is below the failure threshold and above the sub-optimal threshold and the corresponding drill assembly is operating at a sub-optimal state (e.g., 0.5-1.0), the risk of failure can be medium. If the DI of the drill assembly is below the sub-optimal threshold and the corresponding drill assembly is operating at an optimal state (e.g., below 0.5), the risk of failure can be low.

Referring back to FIG. 1, the risk of failure determined by the DI engine 134 can be provided to the drilling controller 106 during drilling operations of the drill assembly 102. Particularly, the drilling controller 106 can adjust operational parameters (within the pre-established safe operation guardrail range) based on the risk of failure determined by the DI engine 134. That is, the drilling controller 106 can provide the drill assembly 102 with operational parameters such as torque. An operational parameter such as torque can contribute to a subset of parameters identified by the drill assembly machine learning model 130, which also contributes to the risk of failure of the drill assembly 102 as indicated by the DI. Accordingly, if the DI engine 134 provides the drilling controller 106 with an indication that the risk of failure is high, the drilling controller can adjust an operational parameter to reduce the risk of failure, such as reducing the torque of the drill assembly 102. If the DI engine 134 provides the drilling controller 106 with an indication that the risk of failure is low, the drilling controller 106 can adjust an operational parameter to increase output of the drill, such as increasing the torque of the drill assembly 102. That is, if the drill assembly 102 has a low risk of failure, the drilling controller 106 can increase torque to increase the amount of Earth that is bored.

Furthermore, the DI engine 134 can provide a risk of failure for future time series to predict a change in risk. Therefore, the drilling controller can adjust operational parameters (e.g., increasing torque) to increase the amount of Earth that is bored while maintaining a low risk of failure of the drill assembly 102. Because the DI engine 134 can predict a future risk of failure, the DI engine 134 can generate a maintenance profile for the drill assembly 102 based on predicted failures. The maintenance profile can include the historical record and previously executed maintenance operations on the drill assembly 102 or other similarly situated drill assemblies.

Figure 5:
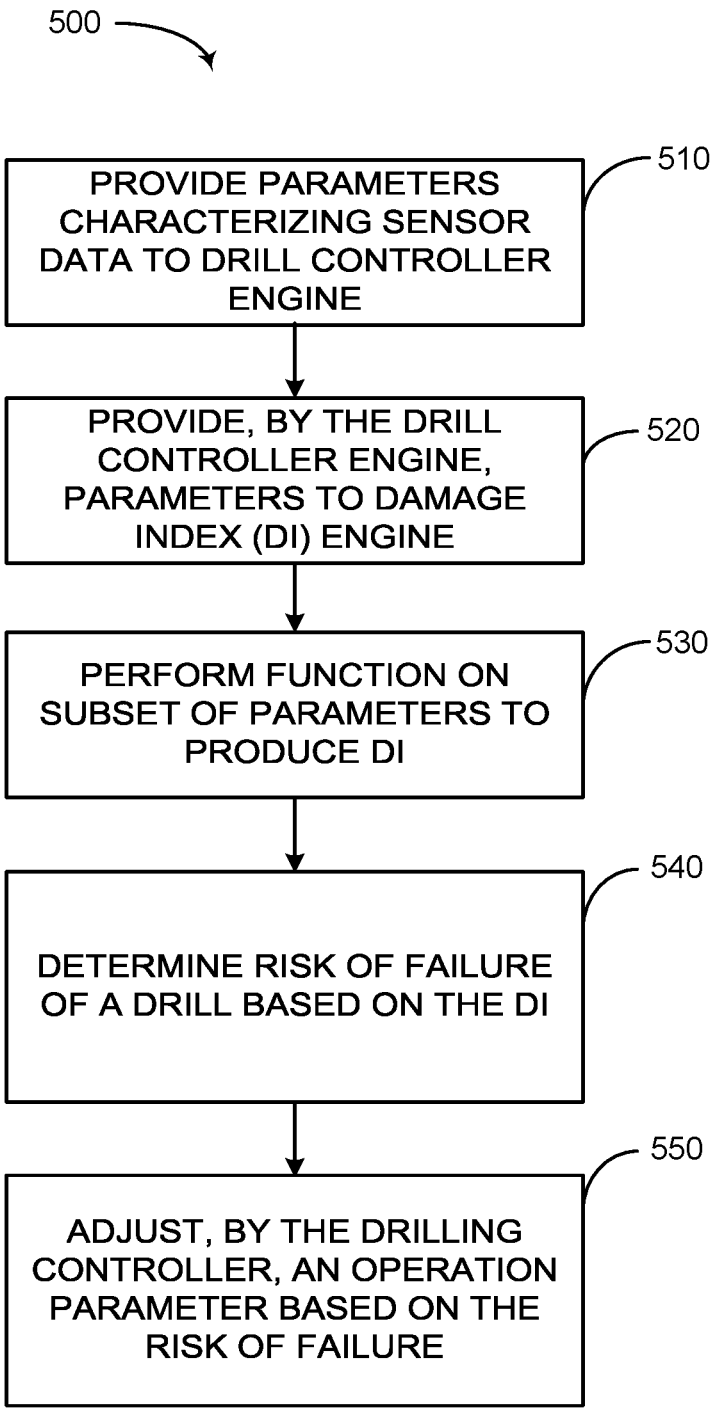
FIG. 5 illustrates a flowchart of an example method for intelligently guiding a drilling system using a DI.
Figure 6:
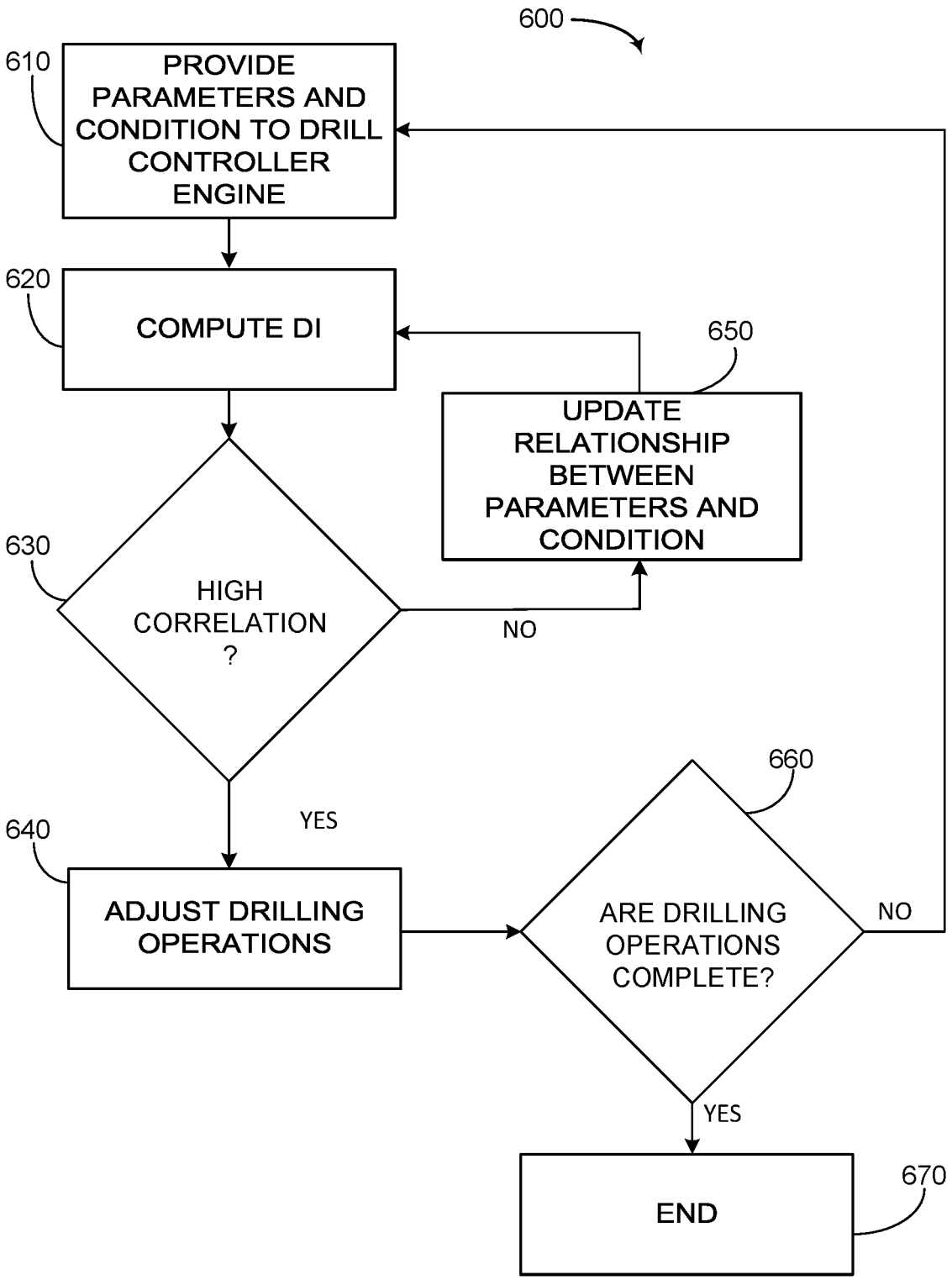
FIG. 6 illustrates a flowchart of another example method for intelligently guiding a drilling system using a DI.

In view of the foregoing structural and functional features described above, an example method will be better appreciated with reference to FIGS. 5 and 6. While, for purposes of simplicity of explanation, the example method of FIGS. 5 and 6 are shown and described as executing serially, it is to be understood and appreciated that the present examples are not limited by the illustrated order, as some actions could in other examples occur in different orders, multiple times and/or concurrently from that shown and described herein. Moreover, it is not necessary that all described actions be performed to implement a method.

FIG. 5 illustrates an example method 500 for employing a DI during drilling operations. The method 500 can be executed by a system for boring the Earth's surface, such as the system 100 of FIG. 1. At 510, parameters are provided to a drill controller engine (e.g., the drill controller engine 112 of FIG. 1). The parameters characterize sensor data collected at a corresponding drill. At 520, the drill controller engine provides the parameters to a DI engine (e.g., the DI engine 134 of FIG. 1). As previously described, the DI engine is preconfigured to identify a subset of the parameters. Accordingly, at 530, the DI performs a function on the subset of parameters to calculate a DI. At 540, the DI engine determines a risk of failure of the corresponding drill assembly based on the calculated DI. Thus, at 550, the drill controller engine can adjust operation parameters of the corresponding drill assembly based on the risk of failure determined by the DI.

FIG. 6 illustrates another example method 600 for employing a DI during drilling operations. The method 600 can be executed by a system for boring the Earth's surface, such as the system 100 of FIG. 1. At 610, a set of parameters and a condition of a drill assembly (e.g., the drill assembly 102 of FIG. 1) are provided to a drill controller engine (e.g., the drill controller engine 112 of FIG. 1). At 620, a DI can be computed for a subset of the parameters provided to the drill controller engine. That is, a DI can be calculated by a DI engine (e.g., the DI engine 134 of FIG. 1) in response to receiving the parameters from the drill controller engine (e.g., the DI engine 134 of FIG. 1), such as the example method 500 of FIG. 5. At 630, the drill controller engine can determine if there is a high correlation between the risk of failure of the drill assembly based on the computed DI to the actual condition of the drill assembly and corresponding parameters. For example, the DI can be below a sub-optimal threshold (e.g., the sub-optimal threshold 430 of FIG. 4) indicating that the drill assembly is operating in an optimal state and that the risk of failure is low. Accordingly, if the determination at 630 is positive (e.g., YES), such that the DI indicates a low risk of failure and the condition received by the drill controller engine is non-failure, the method 630 proceeds to 640. Therefore, at 640, the drill controller engine can adjust the drilling operations appropriately.

Conversely, if the determination at 630 is negative (e.g., NO), the DI can be above a failure threshold (e.g., the failure threshold 440 of FIG. 4) indicating that the drill assembly is operating in a failure state and that the risk of failure is high and that there is a low correlation between the risk of failure and the condition, and the method 600 proceeds to 650. At 650, the drill controller engine can provide the parameters and condition to a drill assembly machine learning model (e.g., the drill assembly machine learning model 130 of FIG. 1) to update a pre-determined relationship between the parameters (e.g., subset of parameters) and the condition, and the method 600 returns to 620. Thus, the updated relationship between the parameters and the condition can employed by the DI engine to compute the DI and determine the risk of failure at 620, such that the risk of failure determined from the DI can be further employed by the drill controller engine to adjust drilling operations at 640. At 660, the drill controller engine can determine whether the drilling operations are complete. If the determination at 660 is positive (e.g., YES), the method 600 proceeds to 670, and the method 600 ends. If the determination at 600 is negative (e.g., NO), the method 600 returns to 610.

What have been described above are examples. It is, of course, not possible to describe every conceivable combination of components or methodologies, but one of ordinary skill in the art will recognize that many further combinations and permutations are possible. Accordingly, the disclosure is intended to embrace all such alterations, modifications and variations that fall within the scope of this application, including the appended claims. As used herein, the term "includes" means includes but not limited to, the term "including" means including but not limited to. The term "based on" means based at least in part on". Additionally, where the disclosure or claims recite "a," "an," "a first," or "another" element, or the equivalent thereof, it should be interpreted to include one or more than one such element, neither requiring nor excluding two or more such elements.

What is claimed:

1. A non-transitory computer readable medium storing a computer readable program that causes a processor to:

receive, by a drill controller engine, a set of parameters characterizing sensor data from a plurality of sensors corresponding to drilling operations of a drill assembly for boring the Earth, and a condition of the drill assembly;

aggregate, by the drill controller engine, the set of parameters and the condition of the drill assembly into a historical record over time, wherein the historical record comprises a first class of parameters correlating to non-failure conditions of the drill assembly and a second class of parameters correlating to failure conditions of the drill assembly, and the historical record is balanced with synthetic examples of failure conditions for the drill assembly generated for the second class of parameters;

select, by a drill assembly machine learning model, a subset of parameters of the set of parameters related to the condition of the drill assembly, wherein a relationship between the subset of parameters to the condition are determined and weighted by the drill assembly machine learning model;

apply, by the drill assembly machine learning model, weights to each parameter of the subset of parameters and weights to different levels of each parameter of the subset of parameters;

compute, by a damage index (DI) engine, a DI for the subset of the set of parameters;

match, by the damage index engine, the computed DI to a plurality of DIs for the historical record over time to determine a risk of failure of the drill assembly based on the DI; and adjust, by the drill controller engine, the drilling operation of the drill assembly to change a given parameter in response to the determined risk of failure.

2. The medium of claim 1, wherein the drill assembly is operating in an optimal state during intervals of time that the DI is below a sub-optimal threshold, the drill assembly is operating in a sub-optimal state during intervals of time that the DI is above the sub-optimal threshold, and the drill assembly is operating at a failure state during intervals of time that the DI is above a failure threshold.

3. The medium of claim 2, wherein the risk of failure for the optimal state is low, the risk of failure for the sub-optimal state is medium, and the risk of failure for the failure state is high.

4. The medium of claim 3, wherein the drill controller engine adjusts the drilling operation of the drill assembly is by decreasing a torque or pressure parameter of the drill assembly in response to the risk of failure being medium, wherein the torque or pressure parameter are defined by operational parameter guardrails.

5. The medium of claim 3, wherein the drill controller engine adjusts the drilling operation of the drill assembly by ceasing drilling operations of the drill assembly in response to the risk of failure being high.

6. The medium of claim 3, wherein a future risk of failure at a future instance of time is predicted based on DIs calculated for two or more previous instances of the historical record and a maintenance profile of the drill assembly.

7. The medium of claim 6, wherein the drill controller engine adjusts the drilling operation of the drill assembly by increasing a torque or pressure parameter in response to the future risk of failure being low.

8. The medium of claim 6, wherein the machine learning model is a random forest decision tree.

9. The medium of claim 1, wherein the drill controller engine provides an alert to a drilling controller in response to the risk of failure exceeding a threshold.

10. The medium of claim 1, wherein the historical record over time stores parameters and conditions of other drill assemblies during other drilling operations.

11. The medium of claim 10, wherein the DI is updated by the machine learning model in response to another drilling operation by the drill assembly.

12. The system of claim 1, wherein the computer readable program that further causes the processor to oversample the second class of parameters using a Synthetic Minority Oversampling Technique to generate the synthetic examples of the failure conditions.

13. A system comprising:

a drill assembly configured to perform a drilling operation for boring the Earth;

a plurality of sensors coupled to the drill assembly, the plurality of sensors being configured to provide parameters characterizing sensor data from the drill assembly and the drilling operation to a computing platform;

a drill controller engine that:

receives the set of parameters from the plurality of sensors and a condition of the drill assembly;

aggregates the set of parameters and conditions of the drill assembly into a historical record over time, wherein the historical record comprises a first class of parameters correlating to non-failure conditions of the drill assembly and a second class of parameters correlating to failure conditions of the drill assembly, and the historical record is balanced with synthetic examples of failure conditions for the drill assembly generated for the second class of parameters;

a drill assembly machine learning model that:

selects a subset of parameters of the set of parameters related to the condition of the drill assembly, wherein a relationship between the subset of parameters to the condition are determined and weighted by the drill assembly machine learning model; and applies weights to each parameter of the subset of parameters and weights to different levels of each parameter of the subset of parameters;

a damage index (DI) engine that:

computes a damage index (DI), wherein the DI is a value obtained from performing a function on the subset of parameters; and matches the computed DI to a plurality of DIs for the historical record over time to determine a risk of failure of the drill assembly based on the DI, the risk of failure being low, medium, or high; and wherein the drill controller engine further adjusts the drilling operation of the drill assembly to change a given parameter in response to the determined risk of failure, wherein a low risk of failure corresponds to a DI below a sub-optimal threshold, a medium risk of failure corresponds to a DI above the sub-optimal threshold, and a high risk of failure corresponds to a DI above a failure threshold.

14. The system of claim 13, wherein subset of parameters is related to a condition of the motor of the drill assembly and comprises differential pressure, a number of rotary-to-slide transitions, back reaming time, and time in hole during drilling operations.

15. The system of claim 14, wherein the drill controller engine adjusts the drilling operation of the drill assembly by decreasing the differential pressure parameter or rotary torque parameter in response to the risk of failure being medium or high.

16. The system of claim 14, wherein the drill controller engine adjusts the drilling operation of the drill assembly by increasing the differential pressure parameter or rotary torque of the drill assembly in response to the risk of failure being low.

17. The system of claim 14, wherein the historical record stores parameters and conditions from previous drilling operations of a plurality of drill assemblies.

18. The system of claim 17, wherein the drill controller engine predicts a future risk of failure at a future instance of time based on DI's calculated for two or more previous instances of the historical record.

19. A method for guiding drill assembly operations comprising:

receiving, by a drill controller engine, a set of parameters from a plurality of sensors that characterize a drill assembly and drilling operation, and a condition of the drill assembly;

aggregating, by the drill controller engine, the set of parameters and condition into a historical record over time, wherein the historical record stores parameters and conditions from at least one other drill assembly and corresponding drilling operations, the historical record comprising a first class of parameters correlating to non-failure conditions of the drill assembly and a second class of parameters correlating to failure conditions of the drill assembly, and the historical record is balanced with synthetic examples of failure conditions for the drill assembly generated for the second class of parameters;

selecting, by a drill assembly machine learning model, a subset of parameters of the set of parameters related to the condition of the drill assembly, wherein a relationship between the subset of parameters and the condition are determined and weighted by the drill assembly machine learning model;

applying, by the drill assembly machine learning model, weights to each parameter of the subset of parameters and weights to different levels of each parameter of the subset of parameters;

computing, by a damage index (DI) engine, a DI for the subset of the set of parameters;

matching, by the DI engine, the computed DI to a plurality of DIs for the historical record over time to determine a risk of failure of the drill assembly based on the DI, the risk of failure being low, medium, or high; and adjusting, by the drill controller engine, the drilling operation of the drill assembly to change a given parameter in response to the determined risk of failure, wherein a low risk of failure corresponds to a DI below a sub-optimal threshold, a medium risk of failure corresponds to a DI above the sub-optimal threshold, and a high risk of failure corresponds to a DI above a failure threshold.

20. The method of claim 19, wherein the drill controller engine predicts a future risk of failure at a future instance of time based on DI's calculated for two or more previous instances of the historical record.

21. The method of claim 19, wherein the subset of parameters is related to a condition of the motor of the drill assembly and comprises differential pressure, number of rotary-to-slide transitions, back reaming time, and time in hole during drilling operations.

* * * * *